United States Patent [19]

Garcia

[11] 3,946,462

[45] Mar. 30, 1976

[54] IMPROVEMENTS INTRODUCED INTO MACHINES FOR BREAKING AND STRETCHING TEXTILE FIBERS

[76] Inventor: Antonio Lorenzo Garcia, Los Vascos No. 20, Madrid-3, Spain

[22] Filed: Mar. 22, 1974

[21] Appl. No.: 453,851

[30] Foreign Application Priority Data

Mar. 27, 1973 Spain ..... 413071

[52] U.S. Cl. ..... 19/.41; 19/19; 19/236

[51] Int. Cl.[2] ..... D01G 1/02

[58] Field of Search ..... 19/.3–.58, 19/236, 19, 20, 258, 266, 272

[56] References Cited

UNITED STATES PATENTS

| | | | |
|---|---|---|---|
| 428,257 | 5/1890 | Stewart | 19/19 X |
| 737,311 | 8/1903 | Allison | 19/19 X |
| 2,624,077 | 1/1953 | Winslow | 19/272 |
| 2,801,448 | 8/1957 | Anderson et al. | 19/266 X |

FOREIGN PATENTS OR APPLICATIONS

| | | | |
|---|---|---|---|
| 128,732 | 6/1919 | United Kingdom | 19/19 |
| 510,870 | 8/1939 | United Kingdom | 19/.37 |

*Primary Examiner*—Dorsey Newton
*Attorney, Agent, or Firm*—Mason, Kolehmainen, Rathburn & Wyss

[57] ABSTRACT

In accordance with the invention, the breaking and stretching machines have pressure heads, each one being essentially constituted by two opposed complexes, upper and lower, each one of which includes at least two transmission chains of the Renold type which are meshed with two chain pinions (double, triple, etc) fitted on two strong parallel shafts that are supported by appropriate bearings attached to the lateral elements of the machine bedplate; those corresponding to the lower complex are fixed, while those corresponding to the upper complex are moveable, so that the latter complex may adopt, with respect to the other complex, two limiting positions; one of separation, which permits the introduction of the layer of fibres, and the other, where the elements approach one another, to be utilized during the work and in which the pressure can be adjusted.

1 Claim, 2 Drawing Figures

IMPROVEMENTS INTRODUCED INTO MACHINES FOR BREAKING AND STRETCHING TEXTILE FIBERS

The present invention refers to improvements introduced into machines for breaking and stretching textile fibres, particularly artificial plastic or thermo-plastic fibres, the novelty of which invention represents an evident and substantial improvement with respect to all that is known in the present state of the art.

It is a fundamental object of the present invention to provide machines for breaking and stretching fibres with the aim of recovering continuous or discontinuous waste fibres proceeding from the processes of spinning.

The machines for breaking and stretching fibres to which we refer are utilized in the textile industry for the treatment of threads of considerable length, and are essentially constituted by a succession of pressure heads separated by appropriate distances, through which there circulates the layer of fibres to be treated which, progressively are stretched at the same time as there is produced the breakage by traction of the excessively long threads which are retained by one head and are passed to the following head in accordance with the order of working, which is achieved by means of the known solution that the said pressure heads increase their speed according to their place of work in the complex as the output of the machine is approached.

In the machines at present in use, and with the exception of their working speed (which can be regulated in accordance with the material of the textile fibres being treated), all the pressure heads are equal and are constituted by a roller which is supported tangentially on two other rollers of smaller diameter, below the main roller, with a pressure that can be regulated, and with possibilities of separating the rollers in order to permit the introduction of the layer of fibres, which is caused to pass between the rollers so that the fibres are held in the two above-mentioned tangential lines between the cylinders.

In practice, different mechanical solutions are known for the functioning, operation and regulation of these pressure heads, but in any case their work is not satisfactory when the fibres concerned present high resistance to breakage by traction since two simple tangential lines of pressure are insufficient to retain all the fibres in the thick layer that circulates between the rollers of the head, there being produced among them slipping instead of breakages, for which reason many of them arrive unbroken at the outlet of the machine. It must also be taken into account that the two above-mentioned tangential lines of pressure are not situated side by side, but that one is situated before and the other after the gripping of the layer of fibres on the roller of greatest diameter, which produces the result that, in the majority of cases, the retention of the fibres is effected only by the second tangential line of pressure for the reason that the ends of the fibres in circulation have already passed over the first line, the only effect of such circumstance is to favour slipping between the fibres of the layer.

Other disadvantages presented by the existing machines are the frequent stoppages that they suffer because of the takeup of fibres produced by adherence to the rollers of the head, both in the pressure roller and in the support rollers, and this disadvantage acquires greater importance as the number of heads in the machine increases, which has been one of the solutions which has been applied in an endeavour to overcome the problem of the slipping of fibres mentioned above.

For the moment, the only effective solution consists in causing the material emerging from a breaking and stretching machine, such as that mentioned, through another complementary machine which carries out a function of repetition that completes the stretching of the layer and the breaking of the fibres, even though they are entire or with a length greater than than appropriate for the process of spinning.

The increase in the number of heads gives rise to the formation of stretching and breaking machines whose length exceeds all suitable dimensions, both mechanical and spatial, in which, although in a slightly inferior proportion, there are also produced the long unbroken fibres because of the slipping, and in which there are produced with greater frequency interruptions because of the takeup of fibres on the rollers of which such machines have a greater number. Again, the utilization of the repetition machine to which we have referred increases the manufacturing cost.

The improvements in accordance with the present invention provide a complete and perfect solution to the problem stated since, with their introduction into a machine for breaking and stretching fibres, there is achieved in a single operation the breakage of all the fibres whose length is superior to the distance established (and regulated) between the pressure heads, which latter, instead of each one being constituted by three rollers in contact, determining two tangential lines of pressure separated by a certain distance, now have a completely different organization in which the layer of fibres is transported by a complex of elements which move in a straight line, without rotating, preventing takeups, which elements apply to the layer of fibres, and with an adjustable pressure, a plurality of parallel lines of retention which cover the whole width of the layer, and which, because of being very near to one another, cooperate efficiently in the total retention of the fibres between which slipping movements can no longer be produced.

The achievement of an operation of breakage by traction of the fibres, and of stretching and thinning the layer of fibres in circulation in a completely correct manner has the immediate and advantageous consequence that with only three or perhaps four heads, in accordance with the improvements introduced by the invention, there are substituted the six or more heads with pressure produced by rollers with which the existing machines are fitted, a circumstance which implies the creation of a machine for breaking and stretching which is much smaller than those at present in use, which are much easier to handle and have a much lower cost price, since their working elements are reduced by practically one half.

BRIEF DESCRIPTION OF THE DRAWINGS

In order that the purpose of the invention may be better understood, and merely by way of example, some sheets of drawings are attached in which.

DETAILED DESCRIPTION OF THE PREFERRED EMBODIMENT

Figure 1:
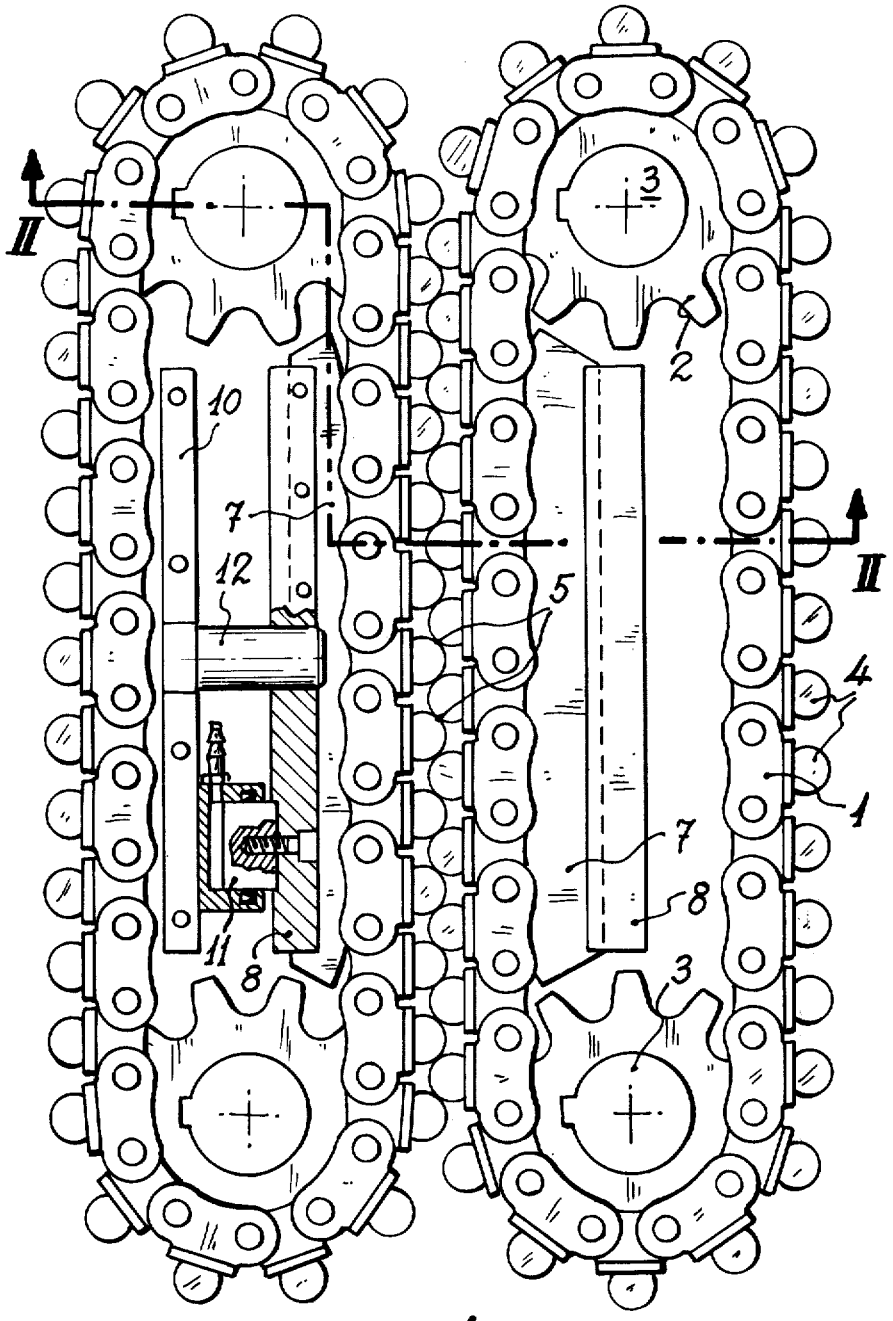
FIG. 1 shows a lateral view of the essential elements that constitute an improved pressure head in accordance with the invention.
Figure 2:
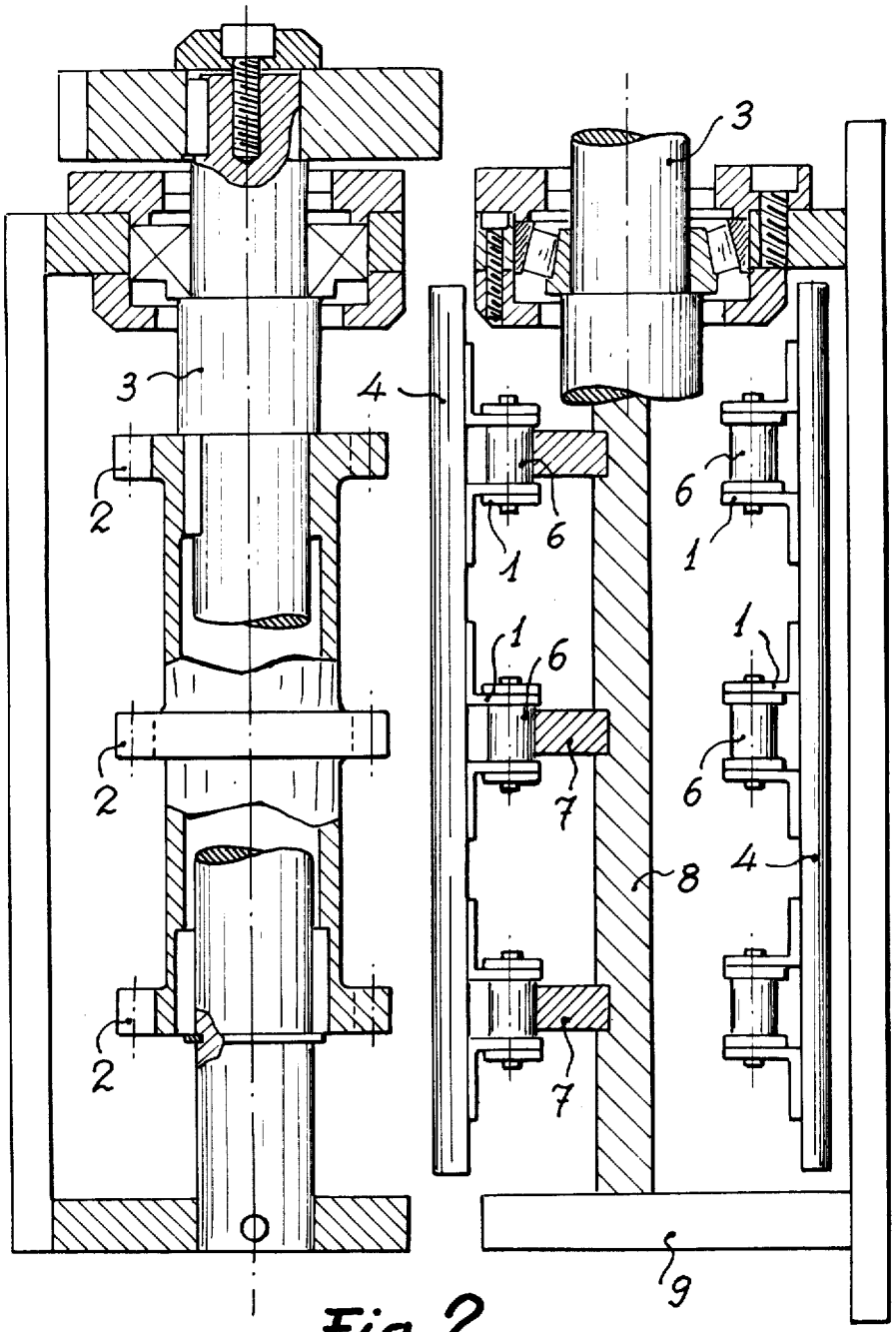
FIG. 2 shows the transverse section through the broken axis II—II of FIG. 1.

As may be seen in the above-mentioned illustrations, the new pressure head is essentially constituted by two opposed complexes, each one of which includes at least two transmission chains of the Renold type (1) (three in the example that we present) which mesh with two chain pinions (2) (double, triple, etc), fitted on strong parallel shafts (3) which are supported by suitable bearings attached to the lateral parts of the bedplate of the machine; those corresponding to the lower complex are fixed, while those corresponding to the upper complex are moveable, so that this latter complex may adopt with respect to the previously mentioned complex two limiting positions: one of separation, which permits the assembly of the layer of fibres, and another of drawing near to be utilized during the work and in which the pressure can be adjusted. In order to bring about these results, various mechanical combinations can be utilized, cooperating with hydraulic and/or pneumatic cylinders.

The essential elements of the new head are bars or cross members (4) whose section is circular with the exception of a segment that determines a longitudinal plane with which each of the said elements is seated on the two fins which, forming a square, extend laterally and in a direction contrary to each one of the links of the chains (1), where they are fixed by means of screws (not shown). These bars or cross members (4) accompany the said chains (1) in their circulating movements and, as can be seen in FIG. 1, have diametral dimensions which are greater than the separation that exists between each two adjacent elements.

In the assembly, the two complexes (the lower fixed complex and the upper moveable complex) are vertically super-imposed, but in such a way that each upper cross member is inserted between two lower cross members, and vice-versa, so that there is produced a large number of tangential lines (5) which, in the example of FIG. 1, as may be seen, are 22, and which are very near to one another since there are produced two on each one of the cross members (4) which are meshed.

In order to avoid the opposing stretches of the chains (1) carrying the cross members (4) becoming curved and thus producing a partial separation of these stretches which would annul the tangential lines (5), the rollers (6) of the chains (1) are sliding, each one being supported on a shoe (7) which is supported by a plate (8) which, in the lower complex, is fixed to the lateral elements of the bedplate of the machine (9), while in the upper complex the said plate (8) is moveable and subsidiary to another supporting plate (10) which is that which is fixed to the bedplate (9).

Between one and another of the upper plates (8,10) there are arranged the elements that permit the adjustment of the working pressure, that is to say the pressure that is applied on each one of the tangential lines (5) on the layer of fibres that is situated between the two batteries of bars or cross members (4). These elements may vary from a set of springs or pre-compressed elastic plates to a set of hydraulic or pneumatic cylinders (11) which, with the backing of the supporting plate (10) transmit their action, through the moveable plate (8) which joins the shoes (7) to the chains (1) of the upper complex and, consequently, to its cross members (4). The relative movements between the two plates (8), (10) are conducted by sliding column guides (12) or those of any other type that maintain the correct alignment of the upper cross members (4) with respect to those of the lower complex.

A pressure head, such as that described, situated in the machine for breaking and stretching, in alignment before or after another similar machine, but rotating at a different speed, constitutes a highly improved element of multiple pressure that retains the layer of fibres if it functions more slowly than the following head, or pulls and breaks the fibres by traction if it operates at a higher speed than the previous head, thus achieving the objectives proposed.

The troublesome takeups of fibres which, up to the present, represented an important negative factor in the performance of the machines for breaking and stretching, are now completely eliminated by the fact that the layer of fibres circulates in a straight line, both between the batteries of bars or cross members (4) and between the spaces existing between two heads, where the layer is stretched by the greater speed of movement of the second of the heads in accordance with the order of circulation in the whole of the machine.

What is claimed is:

1. A machine for breaking and stretching textile fibers comprising at least one pressure head, said pressure head including first and second chain assemblies each having at least two parallel shafts, at least one endless transmission chain mounted for movement around said shafts in each of said chain assemblies, first and second shoe means for supporting each of said chains with a run thereof in direct facing relation with a run of an opposite chain, a fluid cylinder movably secured to one of said shoe means, means supporting one of said shoe means in fixed relation to a facing shoe means supported for movement relative thereto from said cylinder, each of said chains having pairs of links with interconnecting transverse cross members each having portions of substantially circular cross-section for contacting, intermeshing relation between a pair of said portions on cross members of the other chain providing a plurality of tangential lines intermeshing between said chains at the lines of contact of said portions whereby fibers traveling between said chains are engaged by said cross members moving linearly without rotation for subjecting said fiber to a variable meshing pressure at said tangential lines, said portions of circular cross-section of said cross members have a diameter greater than the closest spacing between pairs of adjacent portions on each chain.

* * * * *